United States Patent [19]

Itou et al.

[11] Patent Number: 4,561,275

[45] Date of Patent: Dec. 31, 1985

[54] METHOD OF SHAPING AND MACHINING DISC WHEEL AND EQUIPMENT THEREFOR

[75] Inventors: Susumu Itou, Kawasaki; Kishirou Abe; Morishi Kunou, both of Ayase, all of Japan

[73] Assignee: Topy Kogyo Kabushiki Kaisha, Tokyo, Japan

[21] Appl. No.: 497,428

[22] Filed: May 24, 1983

[51] Int. Cl.[4] ..... B21D 53/26

[52] U.S. Cl. ..... 72/70; 72/110; 29/159.01

[58] Field of Search ..... 72/68, 70, 71, 72, 110; 29/159 R, 159.01, 159.1

[56] References Cited

U.S. PATENT DOCUMENTS

| | | | |
|---|---|---|---|
| 1,003,849 | 9/1911 | Worth | 72/71 |
| 3,204,325 | 9/1965 | Ernestus | 72/70 |
| 3,581,550 | 6/1971 | Waterbury | 29/159.1 |
| 3,712,098 | 1/1973 | Shaffer et al. | 72/71 |

FOREIGN PATENT DOCUMENTS

| | | | |
|---|---|---|---|
| 2250971 | 4/1973 | Fed. Rep. of Germany | 29/159.01 |
| 1419140 | 12/1975 | United Kingdom | 29/159.01 |

*Primary Examiner*—Lowell A. Larson

*Attorney, Agent, or Firm*—Birch, Stewart, Kolasch & Birch

[57] ABSTRACT

A method shaping and machining a disc wheel and an equipment therefor wherein, in a disc wheel formed by welding together a rim and a disc, upper and lower mandrels are inscribed with rim bead seat portions formed on both sides of the rim, while upper and lower spinning rolls are pressed against the outer peripheries of the rim bead seat portions for spinning of the latter, and a hub hole formed in the disc is machined with a cutter which is concentric with the upper and lower mandrels, thereby effecting a high accuracy in shaping and machining a disc wheel.

16 Claims, 5 Drawing Figures

METHOD OF SHAPING AND MACHINING DISC WHEEL AND EQUIPMENT THEREFOR

BACKGROUND OF THE INVENTION

1. Field of the Invention

The present invention relates to a method of shaping and machining a disc wheel used for a vehicle and an equipment used for practicing said method.

2. Description of the Prior Art

A disc wheel used for a vehicle is fabricated by press fitting a disc in a rim and welding said rim and disc by spot welding or $CO_2$ welding. The rim is provided with rim bead seat portions on both sides of the rim for holding a tire. The disc is provided with a hub hole at the center of the disc and it is fitted to the hub of a vehicle through the hub hole. The deviation of the rim bead portions radially from a circle concentric with the hub hole is required to be as small as possible. The smaller the amount of deviation of the rim bead seat portions from said concentric circle is, the more comfortable it will be to ride in the vehicle, while the larger the amount of the deviation is, the less comfortable it will be to drive because of occurrence of vibration during running of the vehicle.

According to the conventional way of forming and machining a disc wheel, for making the above-mentioned deviation small, first, a flat metallic plate is cut into band-shaped plates and said band-shaped plate is rounded to form a ring and both ends of thus rounded band-shaped plate are welded by flash butt welding to form a rough ring. Then the rough ring is passed through a forming machine having multi-stage forming rolls to form rim bead seat portions, being followed by correcting the shape of the rim by means of an expander or a shrinker. On the other hand, a disc is formed under a process different from said process of the rim and the hub hole is machined therein. And in the final step, the so-shaped rim and the so-formed and -machined disc are welded to obtain a disc wheel.

In such a conventional shaping method, however, there has been a problem such that because the expander and shrinker both comprise a split mold, the rim undergoes a local deformation at its portion positioned between the splits, and it is difficult to shape the circumference of the rim to be exactly round.

Moreover, since the shaping operation using a split mold is performed separately for each rim bead seat portion on each side of the rim, it has been difficult to shape both rim bead seat portions concentrically with each other.

Furthermore, because thus shaped rim and the disc thus machined to form a hub hole therein are welded to assembled disc wheel under the final manufacturing process, it has been difficult to align the axis of the circle of the rim bead seat portions and that of the hub hole completely with each other. And for the same reason, the dimension and the shape of the disc wheel are involved in both the errors caused by forming and shaping the rim and errors caused by forming and machining the disk and therefore, it has been difficult to attain a high geometrical accuracy.

SUMMARY OF THE INVENTION

It is an object of the present invention to eliminate a local deformation and a deviation from exact roundness which have inevitably occurred in the conventional shaping using a split mold, by substituting a spinning roll shaping for such a conventional split mold shaping for rim bead seat portions.

It is another object of the present invention to shape rim bead seat portions on both sides of a rim concentrically with each other by performing a simultaneous and concentric shaping for such rim bead seat portions through cooperation of a pair of upper and lower concentric mandrels with a pair of upper and lower concentric spinning rolls in place of the conventional separate shaping using a split mold.

It is a further object of the present invention to eliminate an eccentric condition between rim bead seat portions and a hub hole experienced in the conventional making method of a disc wheel, by virtue of machining the hub hole concentrically with the rim bead portions.

It is a still further object of the present invention to eliminate an involvement of both the errors referred to above by virtue of first welding a rim and a disc together and finally performing both the shaping of rim bead seat portions and the machining of a hub hole in place of the conventional way wherein a rim after shaping and a disc after machining are welded together in the final stage of manufacturing.

BRIEF DESCRIPTION OF THE DRAWINGS

The above and other objects, features and advantages of the present invention will become apparent and more readily appreciated from the following detailed description of a present preferred exemplary embodiment of the invention, taken in conjunction with the accompanying drawings, in which.

DETAILED DESCRIPTION OF THE PREFERRED EMBODIMENT

Figure 1:
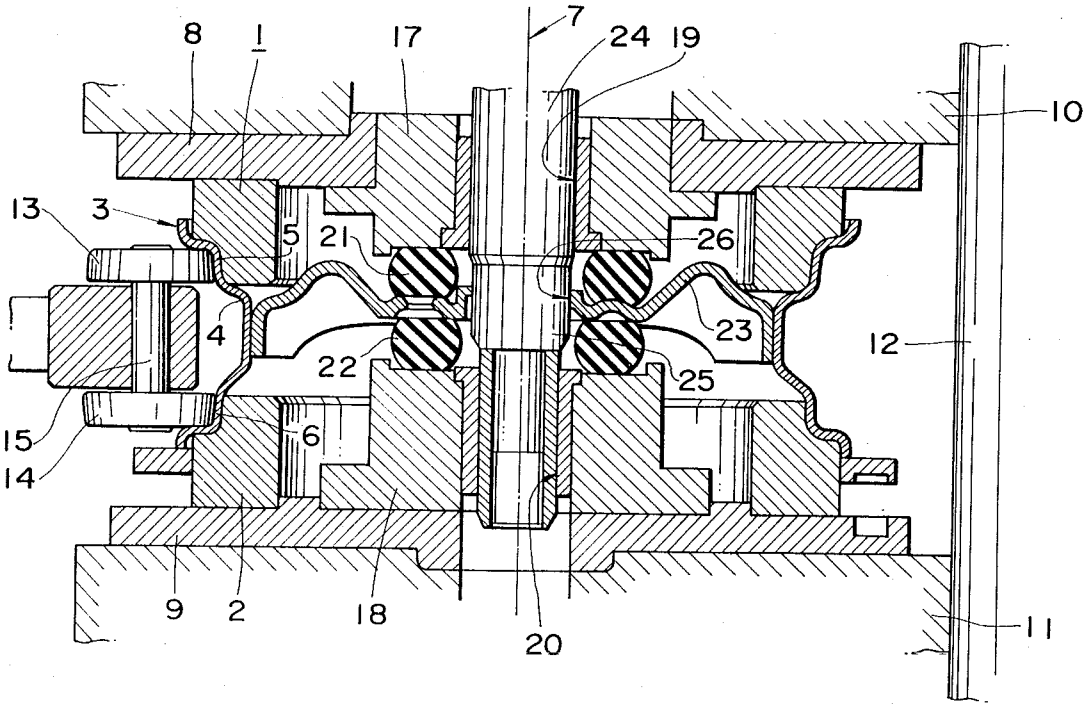
FIG. 1 is a partially sectional view of a disc wheel shaping and machining portion of an equipment for practicing the method of shaping and machining a disc wheel of the invention.

Referring to FIG. 1, there is shown an equipment for practicing the method of the present invention, in which the reference numerals 1 and 2 denote upper and lower mandrels, respectively, disposed in a vertically opposite relation to each other. The upper mandrel 1 and the lower mandrel 2 are of a shape conforming to the inner peripheral shape of rim bead seat portions 5 and 6 formed on both sides of a rim 4 of a disc wheel 3, and have an outer peripheral shape somewhat larger than the inner peripheral shape of the rim bead seat portions 5 and 6. The upper and lower mandrels 1 and 2 are each formed of an annular body and have a common axis 7.

The upper mandrel 1 and the lower mandrel 2 are attached to an upper mandrel holder 8 and a lower mandrel holder 9, respectively, which in turn are attached to an upper rotating table 10 and a lower rotating table 11, respectively. The upper and lower mandrel holders 8 and 9 and the upper and lower rotating tables 10 and 11 have the same axis as the common axis 7 of the upper and lower mandrels 1 and 2.

On a side of the upper and lower rotating tables 10 and 11 is disposed a vertically extending back-up roll 12 against which both rotating tables 10 and 11 are pressed laterally whereby these rotating tables are held concentrically with each other. Both the upper and lower rotating tables 10 and 11 are supported rotatably.

In positions sideways adjacent to the upper and lower mandrels 1 and 2 are disposed an upper spinning roll 13 and a lower spinning roll 14, respectively, which are movable in a direction orthogonal to the common axis 7 of the upper and lower mandrels 1 and 2. As the upper spinning roll 13 approaches the upper mandrel 1, it comes into pressure contact with the outer periphery of the rim bead seat portion 5, while as the lower spinning roll 14 approaches the lower mandrel 2, it is pressed against the outer periphery of the rim bead seat portion 6. The upper spinning roll 13 and the lower spinning roll 14 are supported by a common support shaft 15, and by letting the support shaft 15 approach in the direction of the disc wheel 3, the upper and lower spinning rolls 13 and 14 can be simultaneously brought into contact with the rim bead seat portions 5 and 6 of the disc wheel 3. The support shaft 15 is connected to a laterally actuating hydraulic cylinder 16 whereby the support shaft 15 is moved back and forth in a direction orthogonal to the axis 7.

Upper and lower hub surface pressers 17 and 18 are attached to the upper and lower mandrel holders 8 and 9, respectively. The upper hub surface presser 17 has a vertically extending upper guide hole 19, while the lower hub surface presser 18 has a vertically extending lower guide hole 20. The upper and lower guide holes 19 and 20 have the same axis as the common axis 7 of the upper and lower mandrels 1 and 2. The upper and lower hub surface pressers 17 and 18 are vertically opposite to each other, with upper and lower cushions 21 and 22 being interposed therebetween, which cushions are made of an elastic material such as urethane rubber or the like. A disc 23 of the disc wheel 3 is held between the upper and lower cushions 21 and 22.

Figure 2:
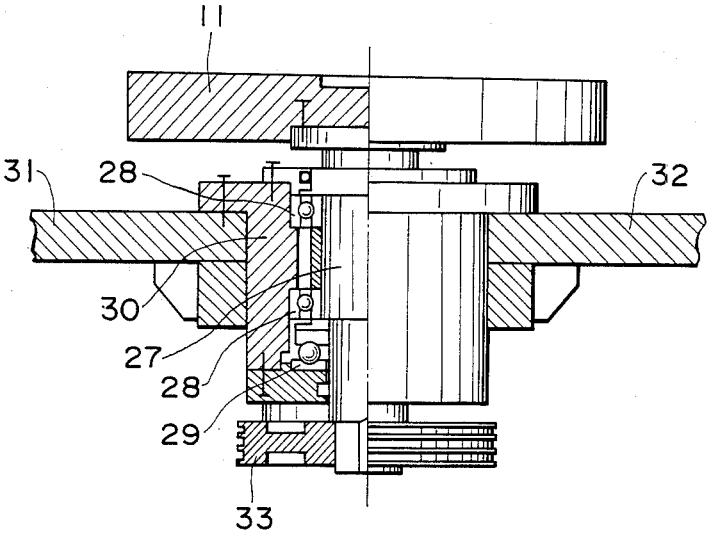
FIG. 2 is a front view, partly in section, of a driving mechanism for a lower rotating disc in the equipment of FIG. 1.
Figure 4:
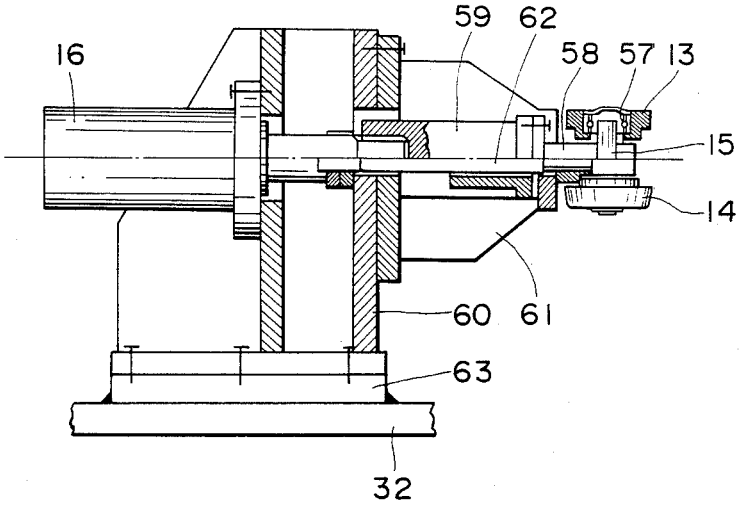
FIG. 4 is a sectional view of a driving mechanism for upper and lower spinning rolls in the equipment of FIG. 1.
Figure 3:
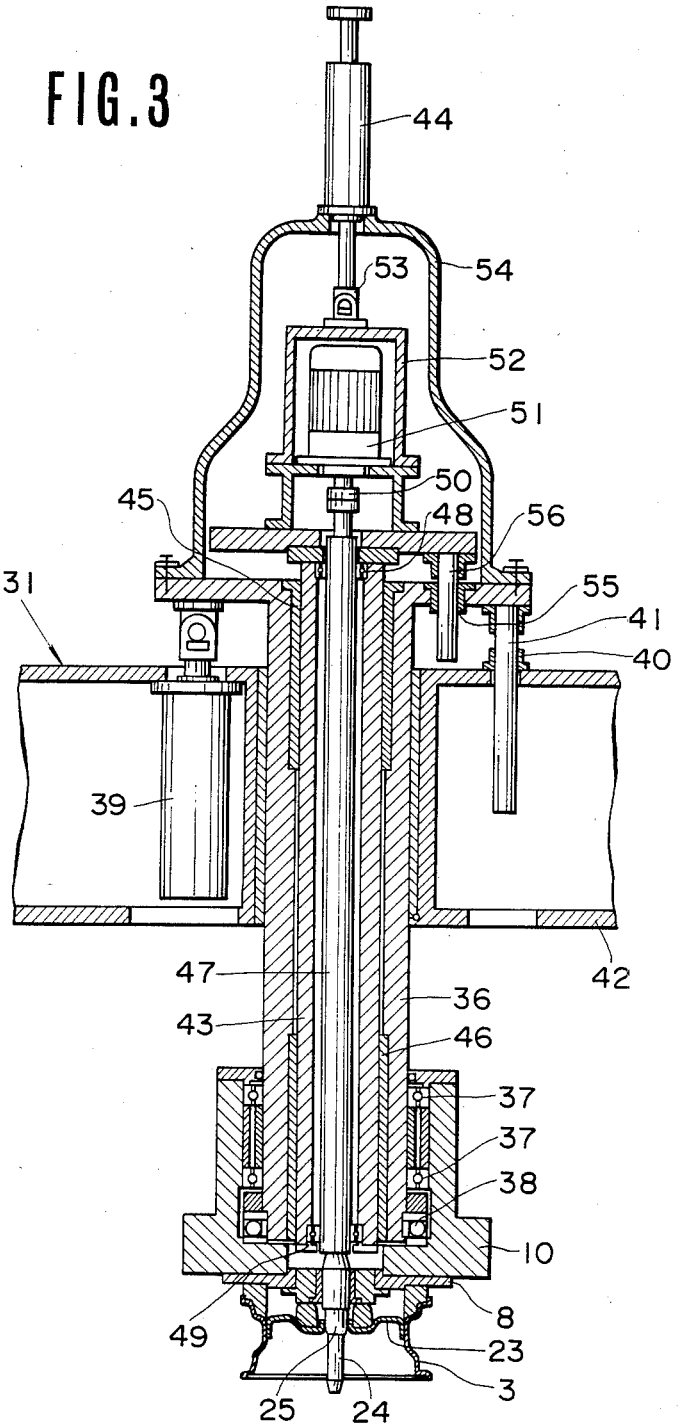
FIG. 3 is a sectional view of a driving mechanism positioned above the disc wheel in the equipment of FIG. 1.

A vertically extending guide 24 is inserted into the upper and lower guide holes 19 and 20 so that it is slidable in vertical and rotational directions with respect to the upper and lower guide holes 19 and 20. In a longitudinally intermediate position of the guide 24 is provided a cutter 25 which has blades on its outer surface. On the other hand, a hub hole 26 is formed centrally in the disc 23 of the disc wheel 3. With a vertical movement of the guide 24, the cutter 25 is moved to the position of the hub hole 26 or to a position away from the hub hole 26. Upon insertion of the guide 24 into the upper and lower guide holes 19 and 20, the axis of the cutter 25 is aligned with the common axis 7 of the upper and lower mandrels 1 and 2. The guide 24 having the cutter 25 is rotatable and vertically movable relative to the upper rotating table 10 and upper mandrel holder 8. FIGS. 2 through 4 illustrate driving devices for the above-described component parts. First as shown in FIG. 2, the lower rotating table 11 is connected to a rotating shaft 27, which is supported by a bearing box 30 through radial bearings 28 and a thrust bearing 29. The bearing box 30 is attached to a bed 32 of a frame 31. The lower end of the rotating shaft 27 projects from the bearing box 30, with a pulley 33 being mounted thereon. The pulley 33 is connected to a rotation driving device 35 through a belt 34. By the rotation driving device 35 the lower rotating table 11 and the disc wheel 3 are rotated.

Referring now to FIG. 3, there is shown a mechanism positioned above the disc wheel 3, in which the upper rotating table 10 to which is attached the upper mandrel holder 8 has a sufficient rigidity and it is supported on a main slide 36 through a radial bearing 37 and a thrust bearing 38. The main slide 36, extending in the vertical direction, is adapted to be moved up and down by a vertically actuating cylinder 39 and it is slidably fitted in the hole of an upper frame 42 of the frame 31 through a bushing 40 and a guide post 41 so that it is not rotatable in the circumferential direction. The main slide 36 incorporates therein a sub-slide 43, which is adapted to be moved up and down axially within the main slide 36 by means of a vertically actuating cylinder 44 for the sub-slide 43. The numerals 45 and 46 denote slide metals which support the sub-slide 43 slidably. In the interior of the sub-slide 43 is mounted a rotation transmission shaft 47 through bearings 48 and 49. The upper portion of the rotation transmission shaft 47 is connected to a rotation driving motor 51 through a shaft coupling 50, while the lower portion thereof is connected to the guide 24. The rotation driving motor 51 is mounted within a casing 52. The upper portion of the casing 52 is connected through a joint 53 to the vertically actuating cylinder 44 for the sub-slide. A casing 54 which supports the vertically actuating cylinder 44 is fixed to the main slide 36. Further, the sub-slide 43 is slidably fitted in the main slide 36 through a bushing 55 and a guide post 56 so that its rotation in the circumferential direction is prevented.

Referring now to FIG. 4, there is shown a driving mechanism for the upper and lower spinning rolls 13 and 14. In the driving mechanism, two shafts 15 each having spinning rolls 13 and 14 are vertically disposed in parallel with each other and therefore, a reaction force from the disc wheel 3 is balanced when the rolls are pressed against the disc wheel 3. The upper and lower spinning rolls 13 and 14 are each supported on the support shaft 15 through a bearing 57 so that they can freely rotate about the support shaft 15, which shaft 15 is fixed to a bracket 58. The bracket 58 is connected to an end portion of a slide 59 which is connected to the laterally actuating cylinder 16, and it is thereby adapted to be moved back and forth along a slide post 62 extending over support bases 60 and 61. The driving mechanism 16 is fixed with bolts to a mounting seat 63 having a flat upper surface and the mounting seat 63 is welded onto the bed 32.

Figure 5:
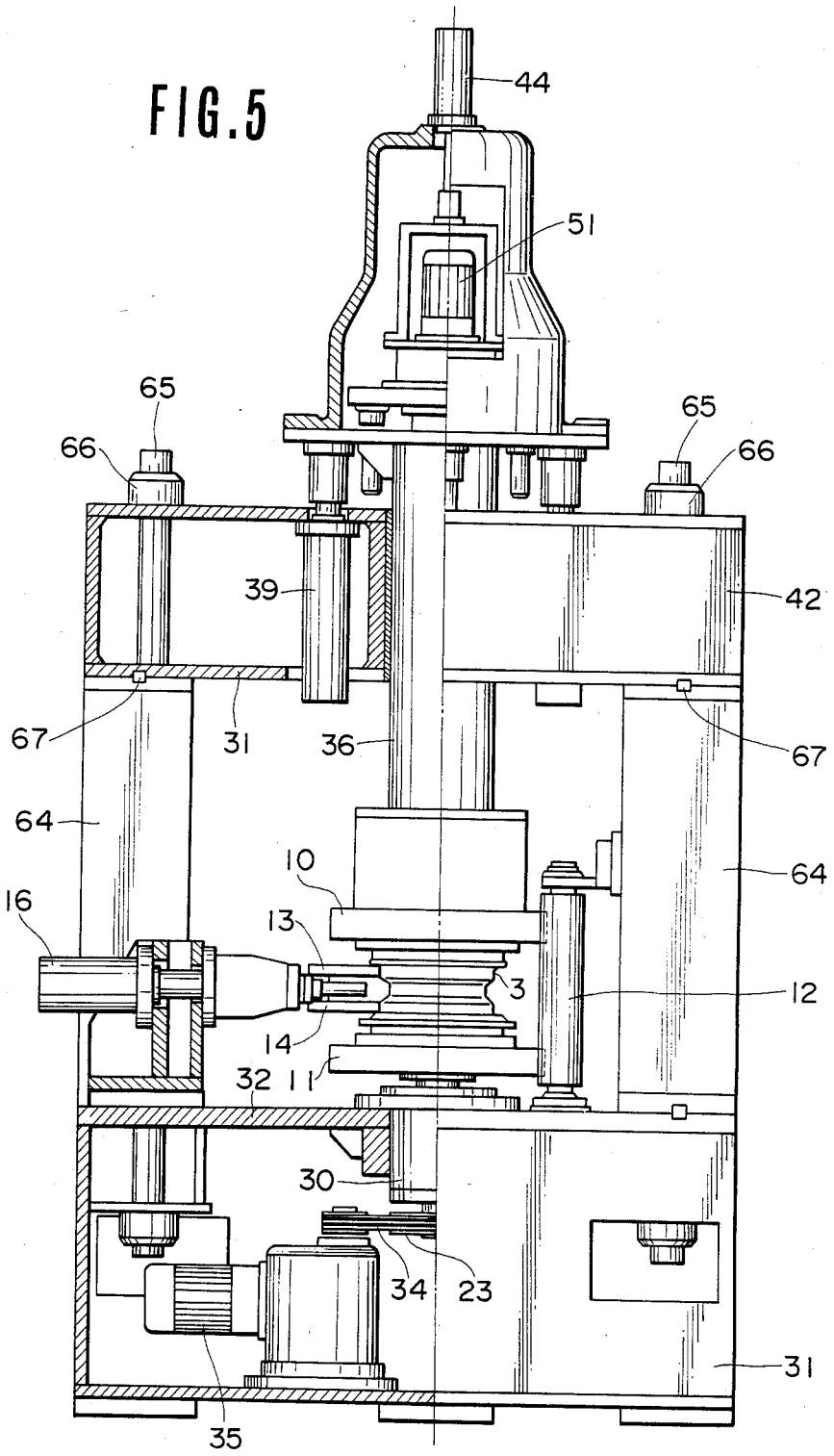
FIG. 5 is a front view, partly in section, showing the entirety of the equipment of the invention.

Referring now to FIG. 5, there is shown the entirety of the equipment, in which the frame 31 comprises the bed 32, upper frame 42 and columns 64, which are tightened together by tie rods 65 and nuts 66. The positioning of them is done by keys 67. On the bed 32 are disposed the mechanism including the lower rotating table 11 and the mechanism including the upper and lower spinning rolls 12 and 13, while on the columns 64 are disposed the mechanism including the back-up roll 12, and on the upper frame 42 is disposed the vertically actuating mechanism for the upper rotating table 10.

Using the equipment constructed as above, the method of shaping and machining the disc wheel of the present invention is practiced in the following manner.

First, the disc 23 is press-fitted in the rim 4 and both are welded together to form the disc wheel 3. The disc wheel 3 thus formed will then be subjected to shaping of the rim bead seat portions 5 and 6 on both sides of the rim 4 and alignment between the rim bead seat portions 5, 6 and the hub hole 26 as mentioned below.

The disc wheel 3 is set on the lower mandrel 2. Then, the upper mandrel 1 coaxial with the lower mandrel 2 is moved down by operation of the vertically actuating cylinder 39, so that the disc wheel 3 is held and compressed between the upper and lower mandrels 1 and 2. At the same time, the outer peripheries of the upper and lower mandrels 1 and 2 come into pressure contact respectively with the inner peripheral surfaces of the rim bead seat portions 5 and 6 formed on both sides of the rim 4. By pressurizing the upper mandrel 1 downwardly, the axis of the disc wheel 3 is automatically aligned with the axis 7 of the upper and lower mandrels 1 and 2.

Then, the lower rotating table 11 is rotated by operation of the rotation driving device 35, whereupon the upper and lower mandrel holders 8, 9, the upper and lower mandrels 1, 2 and the disc wheel 3 rotate together with the lower rotating table 11 because the upper rotating table 10 is being pushed toward the lower rotating table 11. While the disc wheel 3 is held in a rotating state, the upper and lower spinning rolls 13 and 14 are moved toward the disc wheel 3 by operation of the laterally actuating cylinder 16 and are pressed against the rim bead seat portions 5 and 6 respectively. When the upper and lower spinning rolls 13 and 14 supported on the support shaft 15 are pressed against the rim bead seat portions 5 and 6, they rotate around the support shaft 15. The rim bead seat portion 5 is held between the upper spinning roll 13 and the upper mandrel 1 and subjected to spinning process, and the rim bead seat portion 6 is held between the lower spinning roll 14 and the lower mandrel 2 and subjected to spinning process. Through this spinning process, local deformations of the rim bead seat portions 5 and 6 are removed and said bead seat portions are shaped with an exact roundness.

The upper and lower mandrels 1 and 2, even when laterally loaded by the upper and lower spinning rolls 13 and 14, will never become eccentric with each other because the upper and lower rotating tables 10 and 11 are supported laterally by the back-up roll 12. Since the spinning process is effected while the upper and lower spinning rolls 12 and 13 are simultaneously pressed against the upper and lower mandrels 1 and 2 having the common axis 7, the rim bead seat portions 5 and 6 on both sides of the rim 4 are shaped concentrically with each other.

During or after the spinning process for the rim bead seat portions 5 and 6, the cutter 25 having the same axis as the common axis 7 of the upper and lower mandrels 1 and 2 is inserted into the hub hole 26 of the disc 23 and machines the inner surface of the hub hole 26. Insertion of the cutter 25 into the hub hole 26 is effected by moving the sub-slide 43 in the vertical direction by means of the vertically actuating cylinder 44 for the sub-slide, while machining of the hub hole 26 is effected by rotating the rotation transmission shaft 47 by operation of the rotation driving motor 51 to thereby rotate the guide 24 and the cutter 25. The machining of the hub hole 26, however, may be effected even without operation of the motor 51, because the disc wheel 3 rotates relatively to the cutter 25 with rotation of the lower rotating table 11.

Rotation of the cutter 25 by means of the rotation driving motor 51 permits a smooth machining for the hub hole 26.

Since the cutter 25 has the same axis as the common axis 7 of the upper and lower mandrels 1 and 2, the rim bead seats 5, 6 and the hub hole 26 are rendered concentric with each other by machining of the hub hole 26 with the cutter 25.

From the above description it should be readily clear that the following effects are obtained by the present invention.

Since the rim bead seat portions are shaped by spinning process, local deformations and deviation from an exact roundness which have occurred in the conventional shaping operation using a split mold are eliminated.

Moreover, the rim bead seat portions on both sides of the rim are shaped concentrically with each other because they are simultaneously shaped by a pair of upper and lower spinning rolls.

Additionally, the rim bead seat portions and the hub hole are shaped and machined concentrically with each other.

Furthermore, because the shaping of the rim and the machining of the hub hole of the disc are performed after the rim and the disc are welded, the errors caused by forming the rib and by forming the disc have nothing to do with the exact roundness of the circumference of the rim bead portions and the centering between the rim bead portions and the hub hole.

Consequently, the shaping and machining operation for a vehicular disc wheel can be done with a high accuracy, and the driving comfortableness can thereby be improved.

Although only a preferred embodiment of the present invention has been described in detail, it will be appreciated by those skilled in the art that various modifications and alterations can be made to the particular embodiment shown without materially departing from the novel teachings and advantages of this invention. Accordingly, it is to be understood that all such modifications and alterations are included within the scope of the invention as defined by the following claims.

What is claimed is:

1. A method of shaping and machining a disc wheel comprising the steps of:

resiliently holding a disc wheel formed by welding together a rim and a disc between an upper mandrel and a lower mandrel so that said upper and lower mandrels are inscribed with rim bead seat portions formed on both sides of said rim, said upper and lower mandrels having a common axis;

pressing an upper spinning roll against only the outer periphery of said rim bead seat portion on one side of said rim and pressing a lower spinning roll against only the outer periphery of said rim bead seat portion on the other side of said rim while allowing said disc wheel to rotate with rotation of said upper and lower mandrels to effect shaping of said rim bead seat portions by spinning; and inserting a cutter into a hub hole formed in said disc and machining said hub hole with said cutter, said cutter having the same axis as said common axis of said upper and lower mandrels.

2. A method of shaping and machining a disc wheel as defined in claim 1, wherein said disc wheel is set onto said lower mandrel and said upper mandrel is brought down onto said disc wheel to press said disc wheel strongly, and centering of said disc wheel is effected with respect to said upper and lower mandrels.

3. A method of shaping and machining a disc wheel as defined in claim 1, wherein an upper rotating table supporting said upper mandrel through an upper mandrel holder and a lower rotating table supporting said lower mandrel through a lower mandrel holder are supported laterally by a single back-up roll to maintain the coaxial state of said upper and lower mandrels even during said shaping operation by spinning during which a lateral load is imposed on said upper and lower mandrels from said upper and lower spinning rolls.

4. A method of shaping and machining a disc wheel as defined in claim 1, wherein said upper and lower spinning rolls are supported by a common support shaft, and said shaping operation by spinning for said rim bead seat portions is effected by pressing said upper and lower spinning rolls simultaneously against said rim bead seat portions.

5. A method of shaping and machining a disc wheel as defined in claim 1, wherein said disc of said disc wheel is held between an upper hub surface presser and a lower hub surface presser through upper and lower cushions, said upper hub surface presser having an upper guide hole concentric with said upper mandrel, said lower hub surface presser having a lower guide hole concentric with said lower mandrel, and a guide provided with said cutter in a longitudinally intermediate position thereof and slidably fitted in said upper and lower guide holes is moved in its longitudinal direction so that said cutter is inserted into said hub hole to machine said hub hole.

6. A method of shaping and machining a disc wheel as defined in claim 1, wherein said disc wheel is rotated by rotation of said upper and lower mandrels, and said hub hole is machined under both the rotation of said disc wheel and the rotation of said cutter.

7. An equipment for shaping and machining a disc wheel comprising:

a lower mandrel holder and an upper mandrel holder movable in the vertical direction with respect to said lower mandrel holder;

an upper mandrel and a lower mandrel, said upper and lower mandrels having a common axis and being attached to said upper and lower mandrel holders respectively;

an upper spinning roll and a vertically spaced lower spinning roll, said upper and lower spinning rolls being movable in a direction orthogonal to said common axis;

resilient means for engaging and supporting said disc wheel on both sides thereof; and a cutter coaxial with said common axis, said cutter being movable in the axial direction thereof.

8. An equipment for shaping and machining a disc wheel as defined in claim 7, wherein said lower mandrel holder is attached to a lower rotating table, said lower rotating table being rotated by a rotation driving means connected thereto.

9. An equipment for shaping and machining a disc wheel as defined in claim 7, wherein said upper mandrel holder is attached to an upper rotating table and said lower mandrel holder is attached to a lower rotating table, and a back-up roll is disposed in a lateral position of said upper and lower rotating tables, said upper and lower rotating tables being in contact with said back-up roll.

10. An equipment for shaping and machining a disc wheel as defined in claim 7, wherein said upper and lower spinning rolls are supported by a common support shaft, said support shaft being movable with respect to said upper and lower mandrels in a direction orthogonal to said common axis of said upper and lower mandrels by means of a laterally actuating hydraulic cylinder connected to said support shaft.

11. An equipment for shaping and machining a disc wheel as defined in claim 7, wherein an upper hub surface presser having an upper guide hole concentric with said upper mandrel is attached to said upper mandrel holder, and a lower hub surface presser having a lower guide hole concentric with said lower mandrel is attached to said lower mandrel holder, said upper and lower hub surface pressers being opposed to each other.

12. An equipment for shaping and machining a disc wheel as defined in claim 11, wherein said resilient means include an upper cushion and a lower cushion holding therebetween said disc of said disc wheel disposed between said upper and lower hub surface pressers.

13. An equipment for shaping and machining a disc wheel as defined in claim 11, wherein a guide is slidably fitted in said upper and lower guide holes, and said cutter is formed in a longitudinally intermediate position of said guide.

14. An equipment for shaping and machining a disc wheel as defined in claim 7, wherein said upper mandrel holder is attached to an upper rotating table, said upper rotating table being rotatably supported by a main slide adapted to be vertically moved by a vertically actuating cylinder.

15. An equipment for shaping and machining a disc wheel as defined in claim 14, wherein a sub-slide is mounted axially movably in the interior of said main slide, said sub-slide being adapted to be vertically moved by a vertically actuating cylinder for sub-slide.

16. An equipment for shaping and machining a disc wheel as defined in claim 15, wherein a rotation transmission shaft is mounted rotatably in the interior of said sub-slide, the upper end of said rotation transmission shaft being connected to a rotation driving motor and lower end thereof being connected to a guide provided with said cutter.

* * * * *